US005919338A

United States Patent [19]

Pulkowski et al.

[11] Patent Number: 5,919,338

[45] Date of Patent: Jul. 6, 1999

[54] CLEANING APPARATUS FOR A PAPERMACHINE FORMING WIRE

[75] Inventors: Jeffrey H. Pulkowski, Roscoe; Matthew Gregersen, Rockton, both of Ill.

[73] Assignee: Beloit Technologies, Inc., Wilmington, Del.

[21] Appl. No.: 08/955,011

[22] Filed: Oct. 20, 1997

[51] Int. Cl.[6] ..... D21F 1/32

[52] U.S. Cl. ..... 162/275; 15/302; 15/309.1; 15/316.1

[58] Field of Search ..... 162/274, 275, 162/276, 279; 15/302, 309.1, 316.1

[56] References Cited

U.S. PATENT DOCUMENTS

| | | | |
|---|---|---|---|
| 4,643,755 | 2/1987 | Reba et al. | 15/309.1 |
| 5,147,508 | 9/1992 | Sweet | 162/374 |
| 5,381,580 | 1/1995 | Kotitschke et al. | 15/309.1 |
| 5,517,714 | 5/1996 | Kotitschke . | |
| 5,660,688 | 8/1997 | Kiviranta | 162/275 |

*Primary Examiner*—Karen M. Hastings
*Attorney, Agent, or Firm*—Raymond W. Campbell; Gerald A. Mathews

[57] ABSTRACT

A cleaning apparatus is disclosed for cleaning and removing contaminants from a forming wire of a paper machine. The apparatus includes a shower which is disposed adjacent to the wire for supplying a cleaning fluid onto one side of the forming wire. A leading blade is disposed downstream relative to the shower. The leading blade contacts the wire on the one side of the wire and extends in a cross-machine direction across the wire. A trailing blade is disposed downstream relative to the leading blade. The arrangement being such that the leading blade and the trailing blade defined therebetween a cross-machine directional slot. The slot is connected to a source of pressurized air so that the pressurized air flows through the slot and through the wire for removing the cleaning fluid and the contaminants from the wire. Furthermore, the trailing blade and the wire define therebetween a wedge shaped gap which converges in a direction from the slot and away from the leading blade. The arrangement is such that in use of the apparatus, there is no contact between the trailing blade and the wire.

17 Claims, 2 Drawing Sheets

CLEANING APPARATUS FOR A PAPERMACHINE FORMING WIRE

BACKGROUND OF THE INVENTION

1. Field of the Invention

The present invention relates to a cleaning apparatus for cleaning and removing contaminants from a forming wire of a paper machine.

More specifically, the present invention relates to a cleaning apparatus which includes a shower and a flow of pressurized air for cleaning and removing contaminants from a forming wire of a paper machine.

2. Information Disclosure Statement

Paper is formed by ejecting a slurry of stock between converging forming wires of a paper machine.

Typically, the aforementioned twin wire formers and other types of formers are designed to operate 24 hours a day. However, contaminants from the stock tend to lodge between the interstices of the porous wires.

The uniformity of the forming wire has a significant influence on the uniformity, and therefore the quality of the sheet of paper being made on the wire. Over the long term, non-uniformity can develop in the wire as it becomes randomly clogged by fibers and additives.

Continuously running water showers are used to assist in keeping the fabric clean and to prevent clogging. Much of the water sprayed on the fabric blows through the wire and out the opposite side. Some of the water, however remains in the fabric. The water in the fabric affects drainage from the pulp slurry when it is first introduced on the machine. A non-uniform water distribution leads to a non-uniform web.

One method of preventing a non-uniform water distribution is to use an air jet to blow the shower of water out of the fabric. U.S. Pat. No. 5,381,580 assigned to Voith teaches the aforementioned air jet fabric cleaner and one method of applying an air jet in conjunction with a water shower to clean and dry the wire.

In the design illustrated in U.S. Pat. No. 5,381,580, both of the lands forming the air jet slidingly contact the forming wire. There are several disadvantages with such a design. First, to minimize air usage, the slot must be narrow. However, a narrow slot provides limited dwell time of the wire in the jet. Therefore, the cleaning and drying performance of such cleaning apparatus is adversely affected.

Another disadvantage of the aforementioned arrangement is that with two lands, two wear surfaces are touching the fabric. The incoming surface benefits from the lubricating effect of the cleaning water from the shower. However, if the air jet accomplishes its designed objective, the outgoing or downstream blade has no water for lubrication. Consequently, frictional wear on the wire by the downstream blade decreases the life of the forming wire.

In order to minimize the aforementioned friction between the blades and the wire, the distance that the blades can be pushed into the wire must be minimized. As a consequence, the jet air pressures must be kept as low as possible to prevent pushing the fabric away from the blades.

When air usage is extremely high, the air jet is extreme loud. Furthermore, a substantial amount of water mist is generated.

Additionally, ceramic coatings must be used on both blades in order to minimize friction and this adds to the cost of the end product.

The cleaning apparatus according to the present invention provides an air slot length which is considerable thus allowing an increased fabric or wire dwell time under the air jet.

Also, the present invention provides a cleaning apparatus in which the air slot length and fabric dwell time under the jet can be separately adjusted.

The cleaning apparatus according to the present invention overcomes the shortcomings of the prior art arrangement which require both blades to touch the forming wire.

Accordingly, a primary objective of the present invention is to provide a cleaning apparatus which overcomes the aforementioned problems associated with the prior art arrangements and which makes a considerable contribution to the art of removing contaminants from a forming wire of a paper machine.

Other objects and advantages of the present invention will be readily apparent to those skilled in the art by a consideration of the detailed description contained hereinafter taken in conjunction with the annexed drawings.

SUMMARY OF THE INVENTION

The present invention relates to a cleaning apparatus for cleaning and removing contaminants from a forming wire of a paper machine.

The apparatus includes a shower which is disposed adjacent to the wire for supplying cleaning fluid onto one side of the forming wire.

A leading blade is disposed downstream relative to the shower with the leading blade contacting the wire on the same side as the shower. The leading blade extends in a cross-machine direction across the entire width of the wire.

A trailing blade is disposed downstream relative to the leading blade. The arrangement is such that the leading blade and the trailing blade define therebetween a cross-machine directional slot.

The slot is connected to a source of pressurized air so that the pressurized air flows through the slot and through the wire for removing the cleaning fluid and the contaminants from the wire.

The trailing blade and the wire define therebetween a wedge shaped gap. The gap converges in a direction from the slot and away from the leading blade in a machine direction. The arrangement is such that in use of the apparatus, contact between the trailing blade and the wire is inhibited.

In a more specific embodiment of the present invention, the shower is disposed immediately upstream relative to the leading blade.

Also, the cleaning fluid is water.

Additionally, the shower supplies the cleaning fluid across an entire cross-machine directional width of the forming wire.

More specifically, the leading blade includes an approach surface and a wire contacting surface which is disposed downstream relative to the approach surface.

The wire contacting surface is fabricated from a ceramic.

The trailing blade extends in a cross-machine direction across an entire width of the forming wire.

The slot is of rectangular sectional configuration and runs continuously across the entire width of the forming wire. The slot has a width within the range of 1 to 20 mm and preferably a width within a range 5 to 10 mm.

The gap is of trapezoidal sectional configuration with the gap being widest adjacent to the slot and progressively converging in a machine direction of the forming wire.

The gap converges at an angle within a range 45 to 1 degrees and preferably with the range 25 to 15 degrees.

An extension extends in a machine direction from the trailing blade. The extension and the forming wire define therebetween a further gap which extends in a machine direction from the wedge shaped gap. The further gap in use of the apparatus maintains a substantially uniform clearance between the extension and the forming wire a long an entire cross-machine direction or width of the wire and also in the machine direction.

Many modifications and variations of the present invention will be readily apparent to those skilled in the art by consideration of the detailed description taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various drawings.

DETAILED DESCRIPTION OF THE DRAWINGS

Figure 1:
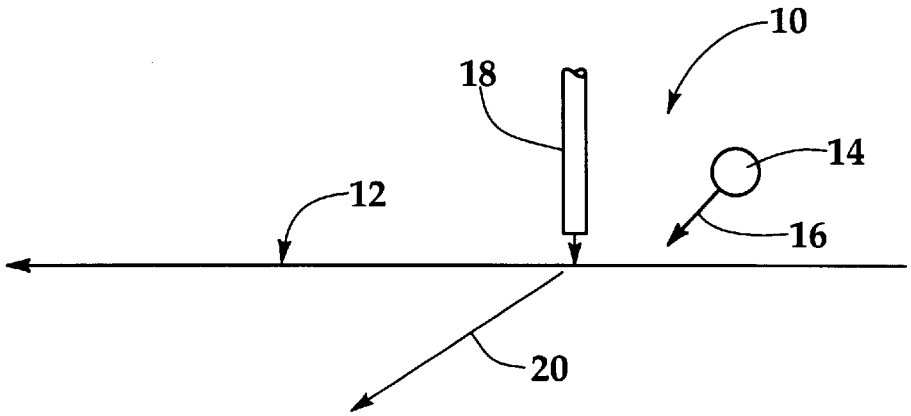
Fig.1 (PRIOR ART)
FIG. 1 is a schematic view illustrating the principal of applying a shower of water onto a forming wire and removing such water together with contaminants by the application of an air jet.

FIG. 1 is a side elevational schematic view of a prior art cleaning apparatus 10 for cleaning a forming wire 12. The cleaning apparatus 10 including a water shower 14 for showering water 16 onto the forming wire 12 and an air jet 18 for removing the water and contaminants from the wire 12.

Figure 2:
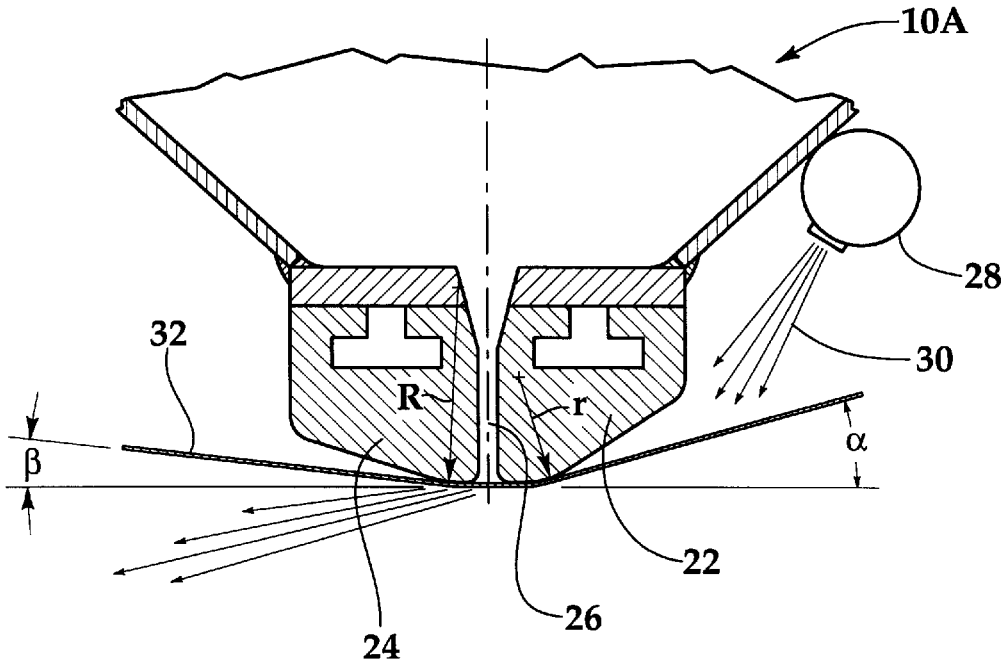
Fig.2 (PRIOR ART)
FIG. 2 is a side elevational view of a prior art cleaning apparatus using an air jet as disclosed in U.S. Pat. No. 5,381,580.

FIG. 2 is a side elevational view of the prior art cleaning apparatus 10A disclosed in U.S. Pat. No. 5,381,580. The cleaning apparatus 10A includes a leading blade 22 and a trailing blade 24 which define therebetween an air jet 26. Ahead of the air jet 26 is a water shower 28 for showering water 30 onto the wire 32 ahead of the air jet 26.

Figure 3:
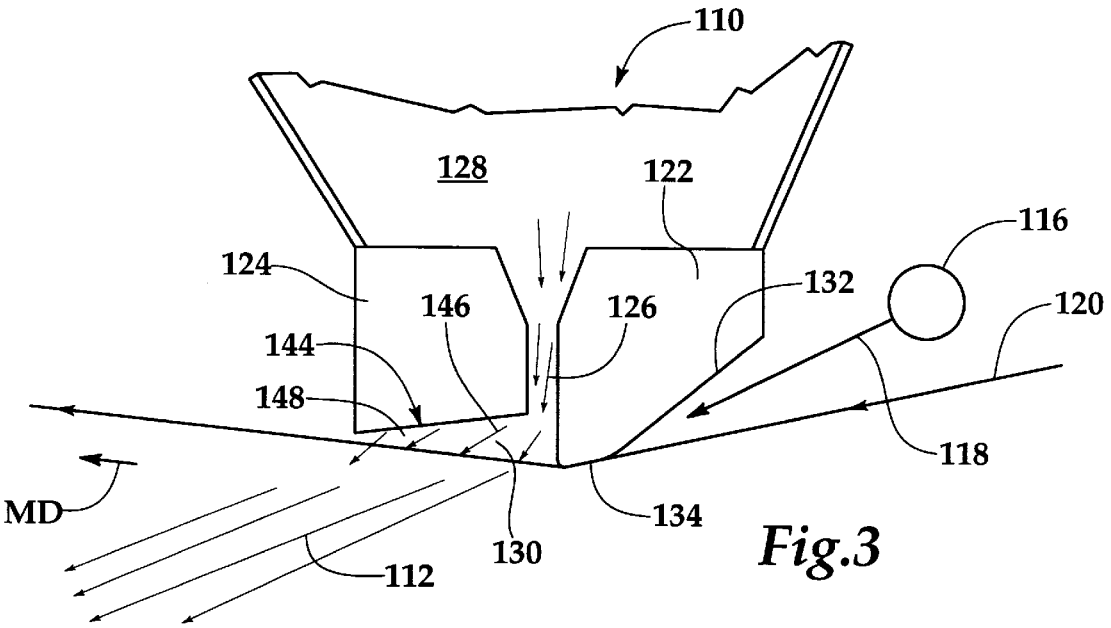
FIG. 3 is a side elevational view of a cleaning apparatus according to the present invention showing the converging wedge.

FIG. 3 is a side elevational view of the cleaning apparatus 110 according to the present invention. The cleaning apparatus 110 is used for cleaning and removing contaminants 112 from a forming wire 114 of a paper machine. The apparatus 110 includes a shower 116 which is disposed adjacent to the wire 114 for supplying a cleaning fluid 118 onto one side 120 of the forming wire 114.

A leading blade 122 is disposed downstream relative to the shower 116. The leading blade 122 contacts the wire 114 on the one side 120 of the wire 114. The leading blade 122 extends in a cross-machine direction across the wire 114.

A trailing blade 124 is disposed downstream relative to the leading blade 122, the arrangement being such that the leading blade 122 and the trailing blade 124 define therebetween a cross-machine directional slot 126.

The slot 126 is connected to a source of pressurized air 128 such that the pressurized air 128 flows through the slot 126 and through the wire 114 for removing the cleaning fluid and the contaminants 112 from the wire 114.

The trailing blade 124 and the wire 114 define therebetween a wedge shaped gap 130. The gap 130 converges in a direction from the slot 126 and away from the leading blade 122 in a machine direction. As indicated by the arrow MD. The arrangement is such that in use of the apparatus 110, contact between the trailing blade 124 and the wire 114 is inhibited.

As shown in FIG. 3, the shower 116 is disposed immediately upstream relative to the leading blade 122.

Also, the cleaning fluid 118 is water and the shower is supplied with the cleaning fluid across the entire cross-machine directional width of the forming wire 114.

The leading blade 122 includes an approach surface 132 and a wire contacting surface 134 which is disposed immediately downstream relative to the approach surface 132. The wire contacting surface 134 is fabricated from a ceramic.

The trailing blade 124 extends in a cross-machine direction across an entire width of the forming wire 114.

The slot 126 is of rectangular sectional configuration and runs continuously across the entire width of the forming wire 114.

The slot 126 has a length L within a range 1 to 20 mm and preferably within a range 5 to 10 mm.

As shown in FIG. 3, the gap 130 is of trapezoidal sectional configuration with the gap 130 being widest adjacent to the slot 126. Also, the gap 130 progressively converges in the machine direction MD of the forming wire 114.

The gap 130 converges at an angle within a range 45 to 1 degrees and preferably within a range 25 to 15 degrees.

Figure 4:
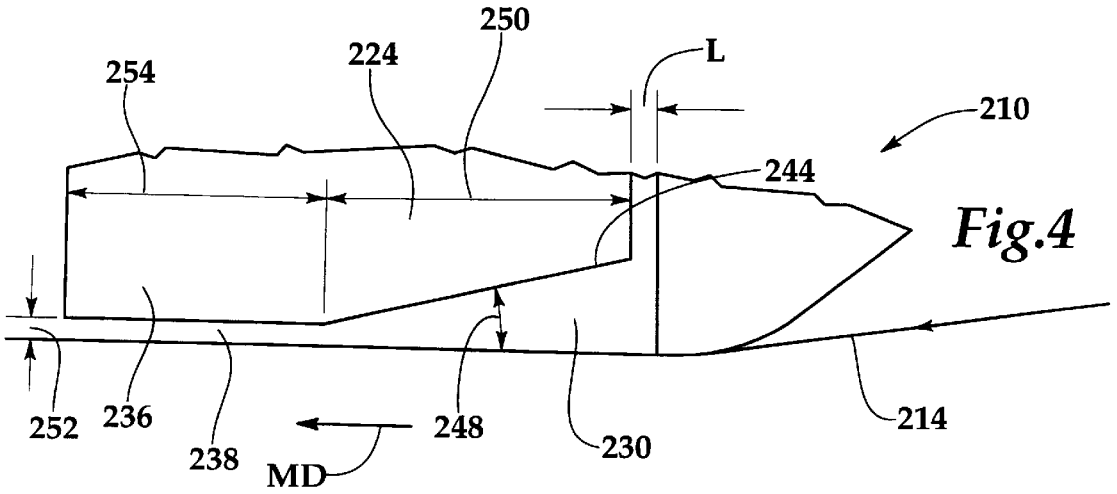
FIG. 4 is a side elevation view of a further embodiment of the present invention showing an extension extending from the trailing blade.

FIG. 4 is a sectional view of a further embodiment of the present invention showing a cleaning apparatus 210 which further includes an extension 236 which extends in a machine direction from the trailing blade 224. The extension 236 and the forming wire 214 define therebetween a further gap 238 which extends in the machine direction MD from the wedge shaped gap 230. The further gap 238 in use of the apparatus 210 maintains a substantial uniform clearance between the extension 236 and the forming wire 214 along an entire cross machine direction and machine direction MD.

Figure 5:
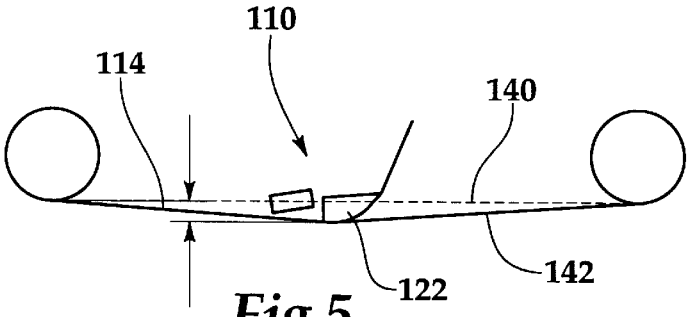
FIG. 5 is similar to the view shown in FIG. 3 but on a smaller scale to illustrate penetration of the leading blade into the wire.

FIG. 5 is similar to the arrangement shown in FIG. 3 but on a larger scale. The dash line 140 indicates the location of the forming wire 114 prior to the leading blade 122 being moved into such forming wire 114. Line 142 shows the cleaning apparatus 110 in operation with the leading blade 122 having penetration into the forming wire 114.

The present invention overcomes the shortcomings of having both leading trailing blades touching the wire. The present invention utilizes a converging surface 144 which converges relative to the wire 114 such converging surface 144 being on the trailing blade 124. The converging surface 144 creates an air wedge between the trailing blade 124 and the wire 114. Such wedge forces air as indicated by arrow 146 through the wire 114 and extends the effective dwell time in which air is blown through the fabric 114. Pressure from the air being forced through the fabric also pushes the wire 114 away from the blade 124 thus preventing contact and subsequent wear on the dry wire 114. With the arrangement according to the present invention, only the leading blade 122 requires a ceramic coating thereby reducing the cost of the apparatus.

Factors which control the performance of the air wedge are the convergence angle 148 and 248 with the wire 114 and 214 and the machine directional length 250 of the converging surface 244. Also, minimum wire clearance 252 or penetration when the air flow is turned off and the length 254 of the blade surface downstream of the converging surface 244.

The effective dwell time and blow through force of the air is controlled through the length and angle of the converging surface 244. The longer the converging surface 244 the more air is forced through the wire leaving less air to bleed past the trailing edge.

Air usage of the air knife is controlled by the slot width L and the blade surface length 254 downstream of the converging angle 248. Air usage due to leaking from the trailing blade is further controlled by the length 254 of the blade downstream from the converging surface as shown in the embodiment of FIG. 5. A longer surface 254 produces more flow resistance thereby reducing the leakage component of the air flow.

Another method of controlling leakage is through the clearance between the trailing blade and the wire. The clearance can vary from a positive 1 mm gap to a penetration equal to the lead in blade. The clearance is measured with the air turned off. Though the blade is penetrating the wire in the air off condition, the wedge design forces the wire to a non-contact configuration when the air is turned on. The maximum allowable trailing blade penetration is determined at the point where the wedge can no longer push the wire to a non-contact position. Such is dependent on blade design air jet pressure and fabric design intention.

By utilizing the air wedge design, the machine operator can independently control lead in blade penetration, air usage and effective dwell time to optimize performance and minimize operating cost.

What is claimed is:

1. A cleaning apparatus in combination with, and for cleaning and removing contaminants from, a forming wire of a paper machine, said apparatus comprising:

a shower disposed adjacent to the wire for supplying cleaning fluid onto one side of the forming wire;

a leading blade disposed downstream relative to said shower, said leading blade contacting the wire on said one side of the wire, said leading blade extending in a cross-machine direction across the wire;

a trailing blade disposed downstream relative to said leading blade, the arrangement being such that said leading blade and trailing blade define therebetween a cross machine directional slot;

said slot being connected to a source of pressurized air such that said pressurized air flows through said slot and through the wire for removing the cleaning fluid and the contaminants from the wire; and said trailing blade and the wire defining therebetween a wedge shaped gap, said gap converging in a direction from said slot and away from said leading blade, the arrangement being such that in use of the apparatus, there is no contact between said trailing blade and the wire.

2. A cleaning apparatus as set forth in claim 1, wherein:

said shower is disposed immediately upstream relative to said leading blade.

3. A cleaning apparatus as set forth in claim 1, wherein:

the cleaning fluid is water.

4. A cleaning apparatus as set forth in claim 1, wherein:

said shower supplies the cleaning fluid across an entire cross-machine directional width of the forming wire.

5. A cleaning apparatus as set forth in claim 1, wherein said leading blade includes:

an approach surface;

a wire contacting surface disposed downstream relative to said approach surface.

6. A cleaning apparatus as set forth in claim 5, wherein:

said wire contacting surface is fabricated from a ceramic.

7. A cleaning apparatus as set forth in claim 1, wherein:

said trailing blade extends in a cross-machine direction across an entire width of the forming wire.

8. A cleaning apparatus as set forth in claim 1, wherein:

said slot is of rectangular sectional configuration.

9. A cleaning apparatus as set forth in claim 1, wherein:

said slot is continuous across the entire width of the forming wire.

10. A cleaning apparatus as set forth in claim 1, wherein:

said slot has a width within a range 1–20 mm.

11. A cleaning apparatus as set forth in claim 1 wherein:

said slot has a width within a range 5–10 mm.

12. A cleaning apparatus as set forth in claim 1, wherein:

said gap is of trapezoidal sectional configuration, said gap being widest adjacent to said slot, said gap progressively converging in a machine direction of the forming wire.

13. A cleaning apparatus as set forth in claim 1, wherein:

said gap converges at an angle within a range 45 to 1 degrees.

14. A cleaning apparatus as set forth in claim 1, wherein:

said gap converges at an angle within a range 25 to 15 degrees.

15. A cleaning apparatus as set forth in claim 1, further including:

an extension extending in a machine direction from said trailing blade, said extension and the forming wire defining therebetween a further gap which extends in a machine direction from said wedge shaped gap, said further gap in use of the apparatus maintaining a substantially uniform clearance between said extension and the forming wire along an entire cross-machine direction and machine direction.

16. A cleaning apparatus in combination with, and for cleaning and removing contaminants from, a forming wire of a paper machine, said apparatus comprising:

a shower disposed adjacent to the wire for supplying cleaning fluid onto one side of the forming wire;

a leading blade disposed downstream relative to said shower, said leading blade contacting the wire on said one side of the wire, said leading blade extending in a cross-machine direction across the wire;

a trailing blade disposed downstream relative to said leading blade, the arrangement being such that said leading blade and trailing blade define therebetween a cross machine directional slot;

said slot being connected to a source of pressurized air such that said pressurized air flows through said slot and through the wire for removing the cleaning fluid and the contaminants from the wire;

said trailing blade and the wire defining therebetween a wedge shaped gap, said gap converging in a direction from said slot and away from said leading blade, the arrangement being such that in use of the apparatus, there is no contact between said trailing blade and the wire; and said gap converging at an angle within a range 25 to 15 degrees.

17. A cleaning apparatus in combination with, and for cleaning and removing contaminants from, a forming wire of a paper machine, said apparatus comprising:

a shower disposed adjacent to the wire for supplying cleaning fluid onto one side of the forming wire;

a leading blade disposed downstream relative to said shower, said leading blade contacting the wire on said one side of the wire, said leading blade extending in a cross-machine direction across the wire;

a trailing blade disposed downstream relative to said leading blade, the arrangement being such that said leading blade and trailing blade define therebetween a cross machine directional slot;

said slot being connected to a source of pressurized air such that said pressurized air flows through said slot and through the wire for removing the cleaning fluid and the contaminants from the wire;

said trailing blade and the wire defining therebetween a wedge shaped gap, said gap converging in a direction from said slot and away from said leading blade, the arrangement being such that in use of the apparatus, there is no contact between said trailing blade and the wire; and said apparatus further including:

an extension extending in a machine direction from said trailing blade, said extension and the forming wire defining therebetween a further gap which extends in a machine direction from said wedge shaped gap, said further gap in use of the apparatus maintaining a substantially uniform clearance between said extension and the forming wire.

* * * * *